US012054856B2

(12) United States Patent
Dressen

(10) Patent No.: US 12,054,856 B2
(45) Date of Patent: Aug. 6, 2024

(54) SLIVER RECEIVING DEVICE AND METHOD FOR FORMING SAME

(71) Applicant: Saurer Intelligent Technology AG, Arbon (CH)

(72) Inventor: Jochen Dressen, Schwalmtal (DE)

(73) Assignee: Saurer Intelligent Technology AG, Arbon (CH)

( * ) Notice: Subject to any disclaimer, the term of this patent is extended or adjusted under 35 U.S.C. 154(b) by 92 days.

(21) Appl. No.: 17/759,115

(22) PCT Filed: Jan. 28, 2021

(86) PCT No.: PCT/EP2021/051898
§ 371 (c)(1),
(2) Date: Jul. 20, 2022

(87) PCT Pub. No.: WO2021/151968
PCT Pub. Date: Aug. 5, 2021

(65) Prior Publication Data

US 2023/0044900 A1 Feb. 9, 2023

(30) Foreign Application Priority Data

Jan. 30, 2020 (EP) ..... 20154601

(51) Int. Cl.
*D01H 9/18* (2006.01)
*D01H 1/115* (2006.01)

(52) U.S. Cl.
CPC ..... *D01H 9/18* (2013.01); *D01H 1/115* (2013.01)

(58) Field of Classification Search
CPC ..... D01H 1/115; D01H 4/02
See application file for complete search history.

(56) References Cited

U.S. PATENT DOCUMENTS

| | | | | |
|---|---|---|---|---|
| 4,635,435 | A * | 1/1987 | Morrison | D02G 3/36 57/328 |
| 5,159,806 | A | 11/1992 | Mori et al. | |
| 5,647,197 | A | 7/1997 | Imamura | |
| 6,209,304 | B1 * | 4/2001 | Feuerlohn | D01H 4/38 57/328 |
| 6,679,044 | B2 | 1/2004 | Anderegg | |
| 2003/0110755 | A1 * | 6/2003 | Anderegg | D01H 4/38 57/333 |

(Continued)

FOREIGN PATENT DOCUMENTS

| | | | |
|---|---|---|---|
| CN | 101498067 | A | 8/2009 |
| DE | 4036119 | A1 | 5/1991 |

(Continued)

*Primary Examiner* — Patrick J. Lynch
(74) *Attorney, Agent, or Firm* — Fox Rothschild LLP

(57) ABSTRACT

The invention relates to a sliver receiving device for supplying a sliver coming from a drafting system to a yarn-forming element of a spinning device, an air jet spinning device and a method for forming a sliver receiving device for supplying a sliver coming from a drafting device to a yarn-forming element of a spinning device. The sliver receiving device according to the invention comprises a main body having an inlet opening for receiving the sliver supplied from the drafting system, and a sliver guide device arranged behind the inlet opening for the defined supplying of the sliver to the yarn-forming element.

12 Claims, 3 Drawing Sheets

(56) References Cited

U.S. PATENT DOCUMENTS

Figure 1:
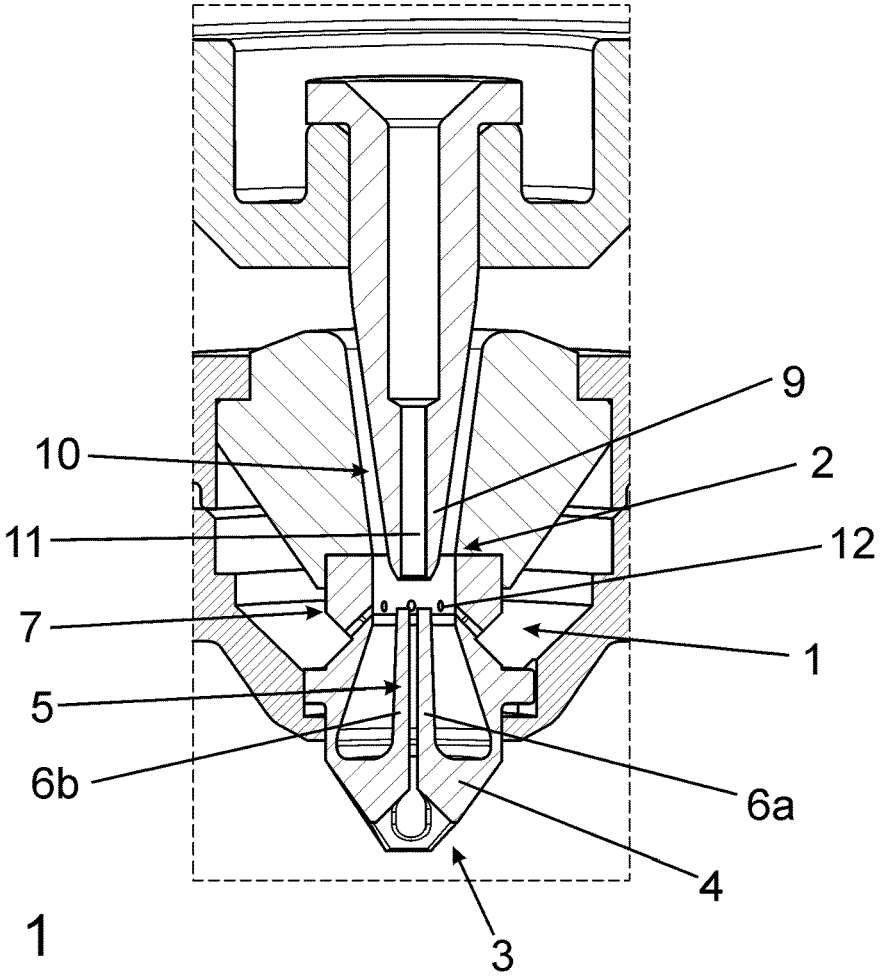

| | | | | |
|---|---|---|---|---|
| 2015/0240393 | A1* | 8/2015 | Haska | D01H 4/02 28/271 |
| 2018/0117675 | A1* | 5/2018 | Foret | B22F 10/32 |
| 2019/0100861 | A1* | 4/2019 | Maleck | B65H 67/085 |
| 2019/0177239 | A1* | 6/2019 | Chaput | B28B 1/001 |

FOREIGN PATENT DOCUMENTS

| | | | |
|---|---|---|---|
| DE | 19603291 | A1 | 8/1996 |
| EP | 0854214 | A2 | 7/1998 |
| EP | 1217111 | A2 | 6/2002 |
| EP | 2009151 | A1 | 12/2008 |

* cited by examiner

SLIVER RECEIVING DEVICE AND METHOD FOR FORMING SAME

CROSS REFERENCE TO RELATED APPLICATIONS

This application is the U.S. national phase of International Patent Application No. PCT/EP2021/051898, filed on Jan. 28, 2021, which claims priority to European Patent Application No. 20154601.7, filed on Jan. 30, 2020, the disclosures of which are incorporated herein by reference in their entirety.

The present invention relates to a sliver receiving device for feeding a sliver coming from a drafting system to a yarn forming element of a spinning device, to an air-jet spinning device having a sliver receiving device, and to a method for forming a sliver receiving device for feeding a sliver coming from a drafting system to a yarn forming element of a spinning device.

Sliver receiving devices for spinning devices, in particular for air-jet spinning devices, are known in various embodiments from the prior art and are commonly used for the controlled feeding of a sliver coming from a drafting system to a spinning nozzle or to a yarn forming element having a spinning nozzle. The sliver receiving devices are typically formed from a plurality of components made of different materials. In particular, a sliver guiding apparatus and, downstream in the sliver running direction, a blowing air nozzle are typically arranged on a basic body.

An air-jet spinning device in the case of which the sliver receiving device is formed from a plurality of components is known, for example, from DE 10 2008 006 379 A1. In the case of this air-jet spinning device, because of the fluid flows used for spinning, in one respect for transporting the sliver and in another respect for spinning the sliver to form a yarn by means of spinning compressed air, a particularly accurate and leak-tight connection between the individual components must be established, and therefore particularly complex and expensive production with very small component tolerances is necessary and the assembly of the spinning device is particularly complicated.

In addition to the problem that the components must be connected in a particularly leak-tight manner in order to prevent the escape of fluid, the devices of the prior art also have the disadvantage that fibres of the sliver are caught at separation points between the individual components during the transport from the drafting system through the sliver receiving device to the spinning nozzle and are thus detached from the sliver, resulting in a reduction in fibres that can be spun to form the yarn and thus lower efficiency of the device and also resulting in the accumulation of the detached fibres in the region of the yarn forming element, which detached fibres can then worsen the spinning result and impair the functionality of the device.

The present invention therefore addresses the problem of providing a sliver receiving device for feeding a sliver coming from a drafting system to a yarn forming element of a spinning device, an air-jet spinning device and a method for forming a sliver receiving device that enable a spinning process with high accuracy and efficiency and in the case of which the accumulation of detached fibres in the device during operation can be reduced and at the same time the device can be produced and assembled particularly simply, economically and flawlessly.

This problem is solved according to the present invention by means of a sliver receiving device having features disclosed herein, an air-jet spinning device having features disclosed herein and a method for forming a sliver receiving device having features disclosed herein.

The sliver receiving device according to the present invention, for feeding a sliver coming from a drafting system to a yarn forming element of a spinning device, comprises: —a basic body, which has an inlet opening for receiving the sliver fed from the drafting system; and —a sliver guiding apparatus, which is arranged downstream of the inlet opening in the sliver receiving direction, for feeding the sliver to the yarn forming element in a defined manner, the sliver guiding apparatus having an individual needle, which is formed integrally with the basic body, or the sliver guiding apparatus being formed from two needles arranged next to each other, the needle tip of which at least partly extends into a blowing air nozzle section formed integrally with the basic body, for producing a rotating air flow, or is arranged upstream of the blowing air nozzle section from the direction of the inlet opening.

The present invention also relates to a spinning device, in particular an air-jet spinning device, comprising a spinning nozzle having a spinning cone, wherein a sliver receiving device according to the present invention is arranged upstream of the spinning cone or upstream of the spinning nozzle in the sliver receiving direction.

In the method according to the present invention for forming a sliver receiving device for feeding a sliver coming from a drafting system to a yarn forming element of a spinning device, a sliver guiding apparatus for feeding the sliver to the yarn forming element in a defined manner, which sliver guiding apparatus is arranged downstream of an inlet opening and is formed from a single needle, is formed integrally with a basic body of the sliver receiving device, or alternatively, in the case of a sliver guiding apparatus arranged downstream of an inlet opening and formed from two needles arranged next to each other, a blowing air nozzle section for producing a rotating air flow in the spinning device is formed integrally with a basic body of the sliver receiving device.

The sliver receiving device according to the present invention advantageously allows a yarn to be produced from a sliver more quickly, more accurately and with fewer defects, in particular because of more accurate construction of the sliver receiving device without separation points. Furthermore, there is no risk of leaks due to separation points and connection points between the basic body of the sliver receiving device, the needle, of which there is at least one, and/or the blowing air nozzle section. Finally, particularly simple, economical and flawless production and assembly are enabled.

A sliver receiving device is first of all basically a component or an assembly that feeds fibre material, in particular a sliver coming from a drafting system, to a spinning nozzle, in particular a spinning cone, or to any other yarn forming element in a controlled manner. The sliver receiving device can in principle be formed from multiple pieces as an assembly or from a single piece as a single component and can be formed from any materials. The sliver receiving device is preferably fastened directly to a spinning device, in particular to an outer housing of a spinning device.

The yarn forming element can in principle be any functional unit or a structural unit composed of one or more components, the yarn forming element being provided for producing a yarn from individual fibres and in particular from a sliver. The yarn forming element preferably comprises a spinning nozzle, in particular an air spinning nozzle, and the yarn forming element particularly preferably comprises a spinning cone of an air spinning nozzle. Accordingly, the spinning device is preferably an air-jet spinning device, within which a sliver is particularly preferably swirled in the region of a spinning cone and in particular in an area between the end of the sliver guiding apparatus and the spinning cone, by means of a rotating spinning compressed air flow or blowing air flow, in such a way that a yarn is formed.

The sliver receiving device has a basic body, on which all other components and constituents of the sliver receiving device are arranged, fastened and/or formed. The basic body is preferably formed as a single piece. According to the present invention, the basic body has an inlet opening in order to be able to receive the sliver, through which inlet opening the sliver is fed. The inlet opening preferably surrounds the sliver over the entire periphery. The inlet opening can be exactly centred or arranged in the region of a central longitudinal axis of the sliver receiving device, or the inlet opening can be shifted and/or angled with respect to said central longitudinal axis. However, the inlet opening runs particularly preferably parallel to and especially preferably exactly on the central longitudinal axis of the sliver receiving device. It is also preferred that the shape and/or the diameter of the inlet opening is selected in such a way that the sliver runs with guidance on all sides and/or can come into contact with a surface of the inlet opening over the entire periphery.

According to the present invention, the sliver guiding apparatus is provided for guiding the sliver, which is fed through the inlet opening into the sliver receiving device, to a yarn forming element in a controlled or defined manner at least in some parts. The sliver guiding apparatus preferably also acts, at the same time, as a twist stopping apparatus that prevents the situation in which all the fibres of the sliver are swirled in the blowing air nozzle section. It is also preferred that the sliver guiding apparatus makes it possible that only the fibre ends protruding from the sliver are swirled around the fibres in the interior of the sliver. For this purpose, a sliver coming from a drafting system is particularly preferably directly fed to the sliver receiving device, in particular through the inlet opening and/or via the sliver table.

According to the present invention, the sliver guiding apparatus is arranged downstream of the inlet opening in the sliver receiving direction, i.e. the sliver guiding apparatus is arranged following the inlet opening in the sliver transport direction and/or is arranged in the interior of the sliver receiving device.

The sliver guiding apparatus can in principle be formed in any way for guiding the sliver in some parts, the sliver receiving device preferably being formed as a single piece or from two needles each formed as a single piece. The sliver guiding apparatus is also preferably completely part of the basic body and/or formed integrally with the basic body. It is also preferred that the sliver guiding apparatus protrudes on one side, in particular on a side away from the inlet opening, out of the basic body and/or to a point upstream of or within the blowing air nozzle section.

The sliver guiding apparatus is preferably arranged, at least partly, upstream of or in the region of the blowing air nozzle section in order to guide the sliver in the region of the blowing air nozzles at least in some parts and/or to protect the sliver from complete capture and swirling. The tip of the sliver guiding apparatus and in particular the tip of the one or more needles are particularly preferably arranged immediately upstream of or in the opening region of an air spinning nozzle and in particular of a spinning cone of an air spinning nozzle.

The sliver guiding apparatus can be formed as a single needle and/or with a single tip, the single needle preferably being rotationally symmetrical in the region of its tip and particularly preferably over essentially the entire length. It is also preferred that the single needle is arranged along or in a central longitudinal axis of the inlet opening or in extension of said central longitudinal axis. According to the present invention, the needle, of which there is at least one, is formed integrally with the basic body.

However, the sliver guiding apparatus can also be formed as two needles or tips that are at least partly arranged next to each other, the two needles preferably forming a tweezers unit. The sliver receiving device is especially preferably a tweezers nozzle, in the case of which the two identical needles arranged next to each other particularly preferably form tweezers. However, the two needles of the sliver guiding apparatus can in principle also be formed with shapes differing from one another.

The two needles arranged next to each other are preferably formed as a single piece and are particularly preferably formed integrally with the basic body. Furthermore, the two needles are preferably arranged parallel to each other and/or are equally long. It is likewise preferred that the two needles are arranged at the same distance from a central longitudinal axis of the inlet opening or from an extension thereof and/or are arranged opposite each other with respect to the central longitudinal axis.

The blowing air nozzle section can in principle be formed by its own component or by a part of another component, in particular by a part of the basic body of the sliver receiving device. The blowing air nozzle section is arranged downstream of the portion of the sliver receiving device having the inlet opening, in the sliver running direction, and/or is provided for feeding spinning compressed air. The blowing air nozzle section of a sliver guiding unit having a single needle is also preferably formed integrally with the basic body.

The blowing air nozzle section is preferably formed as a nozzle block having at least one blowing air nozzle, preferably a plurality of blowing air nozzles. The nozzle block particularly preferably has a closed lateral portion surrounding the blowing air nozzle, of which there is at least one, and the nozzle block is especially preferably cylindrical. Furthermore, a plurality of blowing air nozzles is preferably distributed over the periphery of the blowing air nozzle section, in particular over the periphery of the nozzle block, the blowing air nozzles especially preferably being distributed with equal spacing between each other along the periphery.

The blowing air nozzles in the blowing air nozzle section are preferably directed, in the region of an entry opening of a spinning nozzle, tangentially at a spinning cone so that a rotating air flow is produced. Furthermore, the blowing air nozzles are preferably directed in such a way that the air flow hits an inner surface of an expansion housing, which surrounds the spinning cone, in a plane axially spaced apart from the plane of the entry opening.

In a preferred embodiment of the sliver receiving device according to the present invention, at least the basic body and the sliver guiding apparatus are formed of an identical material, the blowing air nozzle section particularly preferably being formed of the same material as the basic body and/or as the sliver guiding apparatus, in which case particularly simple production and, at the same time, a design free of separation points and connection points are enabled.

Although the sliver receiving device can consist of any material, in a preferred embodiment the entire sliver receiving device is formed of ceramic, in which case particularly good guidance of the sliver and a surface particularly free of separation points and connection points can be established in a simple way. According to a different embodiment of the sliver receiving device according to the present invention, the sliver receiving device has a ceramic coating at least on all fibre-guiding surface sections in order to provide a particularly smooth, stable and durable surface. It is particularly preferred that at least the surface of the needle or needles and/or of a sliver table has a ceramic coating, particularly preferably the entire sliver receiving device having a ceramic coating. The sliver receiving device or at least part of the sliver receiving device particularly preferably has a ceramic coating if the sliver receiving device is formed of a plastic or of metal.

According to an advantageous further development of the sliver receiving device, the two needles are formed and/or arranged mirror-symmetrically to each other. Additionally or alternatively, the two needles can also be arranged rotationally symmetrically and/or mirror-symmetrically with respect to the inlet opening or to a central longitudinal axis of the inlet opening. Such an orientation is preferred particularly if the two needles are each rotationally asymmetrical so that the surface of each needle is adapted to its function and arrangement. The entire needle can be rotationally asymmetrical or only a portion of the needle, in particular a portion of the needle adjoining the basic body or adjoining a sliver table.

According to a preferred embodiment of the sliver receiving device according to the present invention, a sliver table is arranged between the inlet opening and the sliver guiding apparatus, by means of which sliver table the sliver can be guided or, in the operating state of the sliver receiving device, is guided, the sliver table preferably having a closed and continuous surface. The needle or needles preferably extend beyond the sliver table, and the sliver receiving device particularly preferably has, in particular in the region of the sliver table and/or in the transition area to the needle or needles, no connecting point between the components. The entire inner contour and in particular the surface of the sliver table and/or of the needle or needles are especially preferably free of edges and/or free of angles. The sliver receiving device particularly preferably has continuous transition surfaces between the basic body and the needle or needles. The surface of the sliver table can have any shape in principle, but said surface preferably does not have any edges either, and the surface shape of the inner contour or of the sliver table is particularly preferably helical and/or concave and/or convex in parts or completely.

According to an advantageous further development of the air-jet spinning device, the sliver guiding apparatus of the sliver receiving device extends at least partly into the blowing air nozzle section and/or at least partly into an opening in the spinning cone, in which case particularly precise guidance can be achieved while at the same time the fibre ends are sufficiently swirled for yarn formation. Alternatively, the sliver guiding apparatus can also end immediately upstream of the spinning cone in the blowing air nozzle section.

In a first advantageous further development of the method according to the present invention, the sliver receiving device is formed by means of an additive manufacturing method, in which case a sliver receiving device having a complex shape can be produced in a simple way. Furthermore, separation points and connecting points can be reliably avoided by means of an additive manufacturing method. Possible additive manufacturing methods can be, for example, 3-D printing, selective laser melting (SLM), electron beam melting (EMB), binder jetting (BJ), fused deposition modelling (FDM) or laser sintering, in particular with metal materials in each case. Additionally, subsequently or alternatively, the workpiece can also be sintered.

A method in which the sliver receiving device is formed from ceramic and/or by means of stereolithography (SLA) is particularly preferred. If, in contrast, the sliver receiving device should be formed from metal, production by means of laser sintering, in particular selective laser sintering (SLS), is preferred. Alternatively, the sliver receiving device can also be formed in a different way, in particular from metal, and subsequently sintered. Furthermore, it is possible to form the sliver receiving device by interconnecting at least two parts, in particular the basic body and the blowing air nozzle section, without separation points and/or integrally, by sintering or in some other way.

Figure 2:
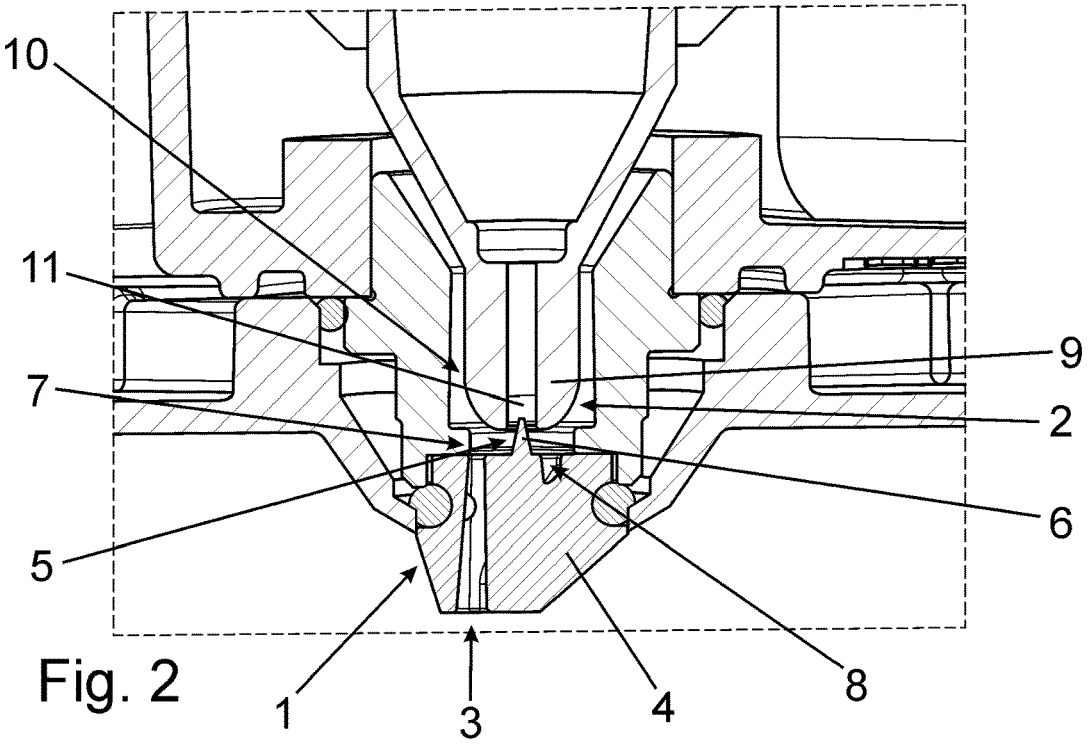
Figure 3B:
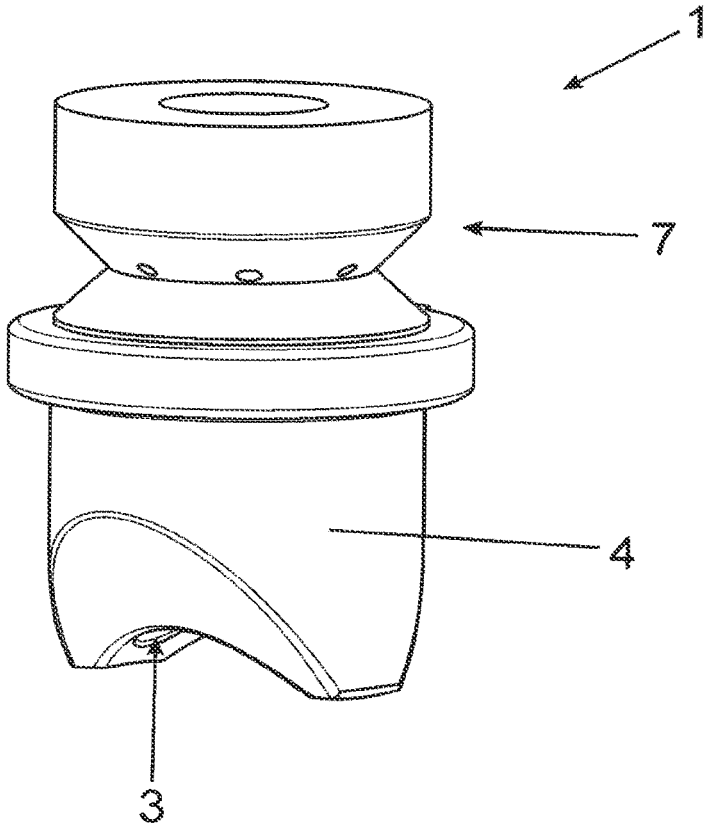
Figure 3A:
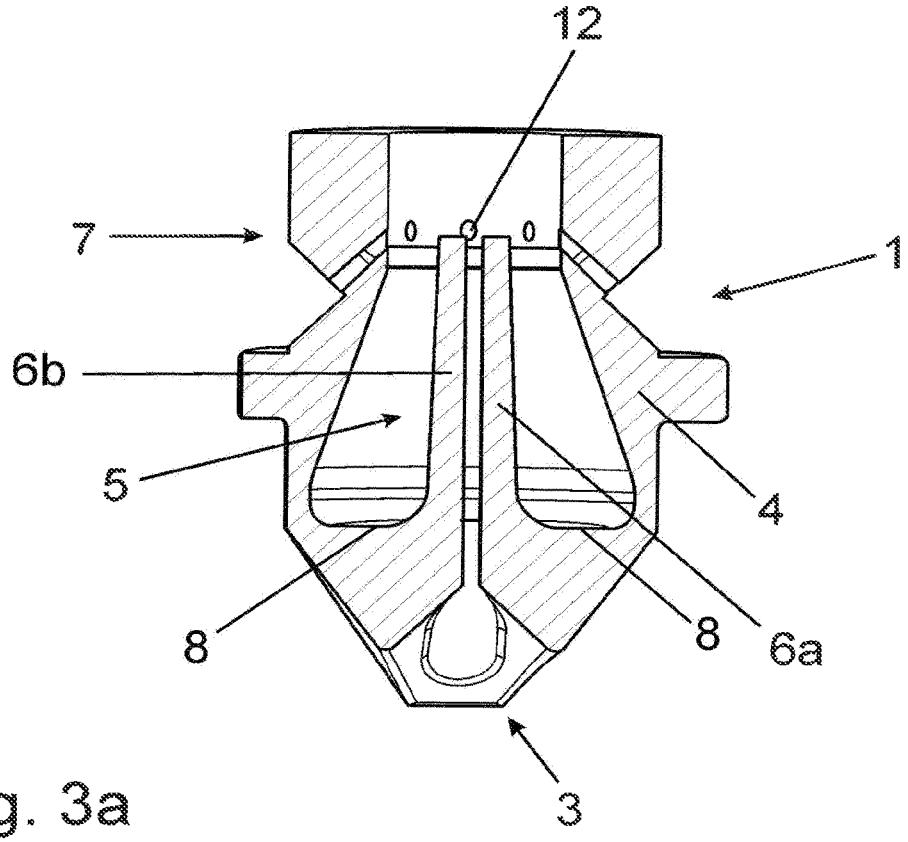
Figure 4A:
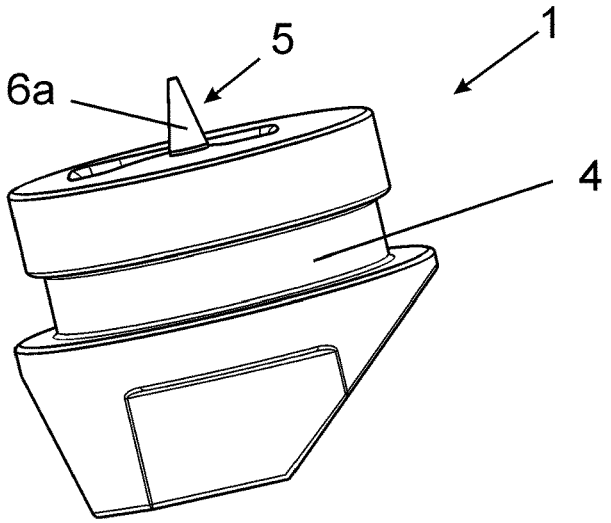
Figure 4B:
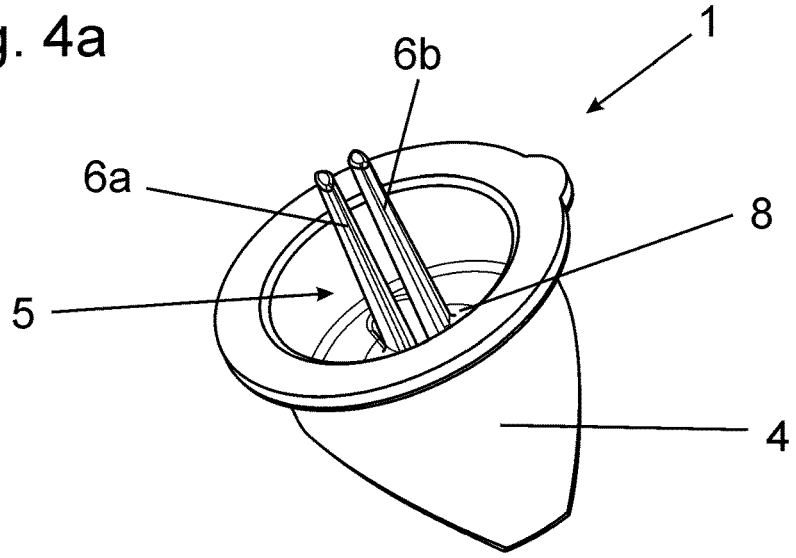
Figure 4C:
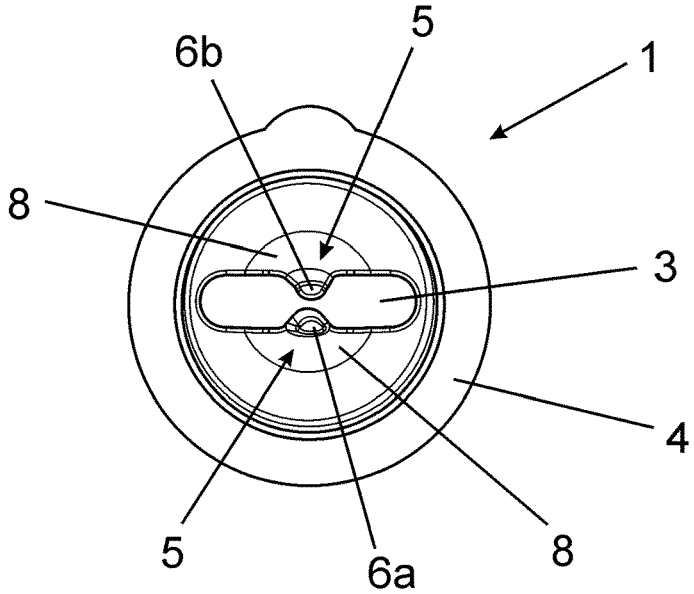

Several embodiment examples of the sliver receiving device according to the present invention and parts thereof are explained in more detail below with reference to the drawings. In the drawings:

FIG. 1 shows a sectional view of a region of an air-jet spinning device having a first embodiment of a sliver receiving device, FIG. 2 shows a sectional view of a region of an air-jet spinning device having a second embodiment of a sliver receiving device, FIG. 3*a* shows a magnified sectional view of the sliver receiving device shown in FIG. 1, with a blowing air nozzle section, FIG. 3*b* shows a perspective outer view of the sliver receiving device shown in FIG. 3*a*, FIG. 4*a* shows a perspective outer view of a part of the sliver receiving device shown in FIG. 3, FIG. 4*b* shows a perspective outer view, rotated relative to FIG. 4*a*, of a part of the sliver receiving device shown in FIG. 3, and FIG. 4*c* shows a top view of the sliver receiving device shown in FIG. 4*a*, the view being directed at a sliver guiding apparatus.

A sliver receiving device 1 shown in FIG. 1 has a single-piece basic body 4 and is arranged in an air-jet spinning device, facing a yarn forming element 2 of the air-jet spinning device. The yarn forming element 2 comprises a spinning nozzle 10 having a spinning cone 9.

The sliver receiving device 1 has an inlet opening 3, through which a sliver coming from a drafting system can be fed to the sliver receiving device 1. The surface of the sliver receiving device 1 is formed, downstream of the inlet opening 3 in the transport direction of the sliver, as a sliver table 8, via which the sliver is fed to a sliver guiding apparatus 5.

The sliver guiding apparatus 5 has the function of feeding the sliver to the yarn forming element 2 in a controlled and defined manner. Furthermore, the sliver guiding apparatus 5 acts as a twist stopping apparatus, which prevents the situation in which the entire sliver or at least excessive portions of the sliver are swirled in the air spinning process. The sliver guiding apparatus 5 is formed as a tweezers nozzle from two needles 6*a, b* arranged parallel to each other, the needles 6*a, b* each being formed integrally with the basic body 4 and extending from the sliver table 8 toward the spinning cone 9.

In order to be able to spin the sliver to form a yarn, a blowing air nozzle section 7 is provided, which is formed integrally with the basic body 4 and is arranged in the region of the yarn forming element 2 (see FIG. 3*b*). The two needles

6*a, b* of the sliver guiding apparatus 5 extend at least partly into the blowing air nozzle section 7 so that the rear, free ends of the edge fibres of the sliver are exposed in the blowing air nozzle section 7 to an air flow exiting from blowing air nozzles 12 after said free ends exit the sliver guiding apparatus 5, said free ends being lifted off or detached from the sliver.

At the same time, the front ends of the fibres are generally not completely detached, because they are already trapped by wrap fibres and inserted into the spinning nozzle 10. The free fibre ends detached from the sliver are wrapped around the spinning cone 9 and given a twist by a rotating air flow produced by means of the blowing air nozzles 12. The rear free ends of the fibres are continuously drawn into an opening 11 in the spinning nozzle 10 by the continuous movement of the sliver in the sliver transport direction, the edge fibres being helically wrapped around the core fibres of the sliver.

However, not all fibres and fibre ends detached from the sliver are spun to form the yarn in this process, and therefore these released fibres can be easily caught at edges and separation points between components of the sliver receiving device 1. Accordingly, a single-piece design of the sliver receiving device 1 is advantageous. Furthermore, a single-piece design prevents leaks between the components, enabling more accurate formation of a rotating air flow in the blowing air nozzle section 7.

The sliver guiding apparatus 5 is formed from two identical needles 6*a, b*, which are arranged parallel to each other on both sides of the inlet opening 3 in the region of the sliver table 8 (see FIG. 3*a*). The tips of the needles 6*a, b* are arranged in the blowing air nozzle section 7 in the region of the outlet openings of the blowing air nozzles 12. Each needle 6*a, b* has a rotationally asymmetrical shape over the entire length and is flattened in particular on the surface section facing the opposite needle 6*a, b*.

As shown in FIGS. 4*a*, 4*b*, and 4*c*, the two needles 6*a, b* continuously adjoin the surface of the sliver table 8, the two needles 6*a, b* being arranged opposite each other mirror-symmetrically. The sliver table 8 has a curved, edgeless surface.

A second embodiment of a sliver receiving device 1, shown in FIG. 2, differs from the first embodiment shown in FIG. 1 significantly in that the blowing air nozzle section 7 having the blowing air nozzles 12 is not formed integrally with the basic body 4 and in that the sliver guiding apparatus 5 is formed from a single needle 6, which is arranged in the entire blowing air nozzle section 7 and extends into the opening 11 in the spinning nozzle 10. Furthermore, the inlet opening 3 is arranged at an offset to and, at the same time, parallel to a central longitudinal axis of the basic body 4, while the needle 6 extends along said central longitudinal axis.

LIST OF REFERENCE SIGNS

1 Sliver receiving device
2 Yarn forming element
3 Inlet opening
4 Basic body
5 Sliver guiding apparatus
6 Individual needle
6*a* First needle
6*b* Second needle
7 Blowing air nozzle section
8 Sliver table
9 Spinning cone
10 Spinning nozzle
11 Opening
12 Blowing air nozzle

The invention claimed is:

1. A sliver receiving device (1) for feeding a sliver coming from a drafting system to a yarn forming element (2) of a spinning device, comprising a basic body (4), which has an inlet opening (3) for receiving the sliver fed from the drafting system, and a sliver guiding apparatus (5), which is arranged downstream of the inlet opening (3) in the sliver receiving direction (1), for feeding the sliver to the yarn forming element (2), wherein a sliver table (8) is arranged between the inlet opening (3) and the sliver guiding device (5), over which table the sliver can be guided, and wherein at least the basic body (4) and the sliver guiding device (5) are formed from an identical material, wherein, the sliver guiding apparatus (5) is formed integrally with the basic body (4) from two needles (6*a*, 6*b*) facing each other alone an inner surface of each of the two needles and parallel to each other alone a width of the inner surfaces, which project beyond the sliver table (8) and, the needle tips of which at least partly extend into a blowing air nozzle section (7) formed integrally with the basic body (4) for producing a rotating air flow or are arranged upstream of the blowing air nozzle section (7) from the direction of the inlet opening (3), the two needles (6*a*, 6*b*) being arranged opposite one another in relation to a central longitudinal axis of the inlet opening (3), wherein the sliver table (8) comprises a substantially flat surface surrounding the two needles (6*a*, 6*b*), and the sliver receiving device (1) is designed without intermediate connection points in the transition region of the sliver table (8) to the two needles (6*a*, 6*b*).

2. The sliver receiving device (1) according to claim 1, wherein the blowing air nozzle section (7) is formed of the same material as the basic body (4) or the sliver guiding apparatus (5).

3. The sliver receiving device (1) according to claim 1, wherein the sliver receiving device (1) is formed of ceramic.

4. The sliver receiving device (1) according to claim 1, wherein the sliver receiving device (1) has a ceramic coating at least on all fibre-guiding surface sections.

5. The sliver receiving device (1) according to claim 1, wherein the two needles (6*a*, 6*b*) are formed and/or arranged mirror-symmetrically to each other.

6. The sliver receiving device (1) according to claim 1, wherein the two needles (6*a*, 6*b*) each have a rotationally asymmetrical shape.

7. The sliver receiving device (1) according to claim 1, wherein the sliver table (8) has a continuous surface.

8. An air-jet spinning device, comprising a spinning nozzle (10) having a spinning cone (9), wherein the sliver receiving device (1) according to claim 1 is arranged upstream of the spinning cone (9) in the sliver receiving direction.

9. The air-jet spinning device according to claim 8, wherein the sliver guiding apparatus (5) of the sliver receiving device (1) extends at least partly into the blowing air nozzle section (7) and/or partly into an opening (11) in the spinning cone (9).

10. A method for forming the sliver receiving device (1) for feeding the sliver coming from the drafting system to the yarn forming element (2) of the spinning device, according to claim 1, wherein the sliver receiving device (1) is formed by means of an additive manufacturing method.

11. The method according to claim 10, wherein the sliver receiving device (1) is formed from ceramic and by means of stereolithography.

12. The method according to claim 10, wherein the sliver receiving device (1) is formed from metal by means of laser sintering.

* * * * *